US008717133B2

(12) United States Patent
Ooishi et al.

(10) Patent No.: US 8,717,133 B2
(45) Date of Patent: May 6, 2014

(54) REACTOR

(75) Inventors: Akinori Ooishi, Mie (JP); Hiromi Yabutani, Mie (JP); Takahiro Onizuka, Mie (JP); Takayuki Sano, Mie (JP); Atsushi Ito, Osaka (JP); Shinichiro Yamamoto, Osaka (JP); Hajime Kawaguchi, Osaka (JP)

(73) Assignees: Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 13/642,784

(22) PCT Filed: Mar. 16, 2011

(86) PCT No.: PCT/JP2011/001553

§ 371 (c)(1),
(2), (4) Date: Oct. 22, 2012

(87) PCT Pub. No.: WO2011/132361

PCT Pub. Date: Oct. 27, 2011

(65) Prior Publication Data

US 2013/0038415 A1 Feb. 14, 2013

(30) Foreign Application Priority Data

Apr. 23, 2010 (JP) ..... 2010-100183
Oct. 29, 2010 (JP) ..... 2010-243041

(51) Int. Cl.

| | |
|---|---|
| ***H01F 27/08*** | (2006.01) |
| ***H01F 27/10*** | (2006.01) |
| ***H01F 27/02*** | (2006.01) |
| ***H01F 27/24*** | (2006.01) |
| ***H01F 27/28*** | (2006.01) |

(52) U.S. Cl.
USPC ..... 336/61; 336/55; 336/60; 336/90

(58) Field of Classification Search
USPC ..... 336/61, 55, 56, 58, 59, 60, 90, 57, 221, 336/220, 212
See application file for complete search history.

(56) References Cited

U.S. PATENT DOCUMENTS 5,926,944 A * 7/1999 Smith et al. ..... 29/602.1
8,012,304 B2 * 9/2011 Brillhart et al. ..... 156/345.27

(Continued)

FOREIGN PATENT DOCUMENTS

JP U-48-22741 3/1973
JP A-2004-39770 2/2004

(Continued)

OTHER PUBLICATIONS

International Search Report issued in International Application No. PCT/JP2011/001553 dated Jun. 14, 2011.

(Continued)

*Primary Examiner* — Alexander Talpalatski
*Assistant Examiner* — Kazi Hossain
(74) *Attorney, Agent, or Firm* — Oliff PLC

(57) ABSTRACT

A reactor including an assembly of a coil, a magnetic core on which the coil is disposed, and a case that houses the assembly. The case includes an installation face, a side wall that is removably attached to the installation face and surrounds the periphery of the assembly, and a heat dissipation layer formed on the inner face of the installation face and interposed between the installation face and the installation-side face of the coil. The installation face consists of aluminum, the side wall consists of an insulating resin, and the heat dissipation layer consists of an adhesive with high thermal conductivity and excellent insulation. The installation face is separate from the side wall, making it easy to form the heat dissipation layer, and having excellent heat dissipation. The side wall consists of an insulating resin, thus reducing the gap between it and the coil.

9 Claims, 6 Drawing Sheets

(56) References Cited

U.S. PATENT DOCUMENTS

| | | | | |
|---|---|---|---|---|
| 2009/0027151 | A1* | 1/2009 | Nakatsu et al. | 336/212 |
| 2009/0108971 | A1* | 4/2009 | Okamoto | 336/65 |
| 2010/0026434 | A1* | 2/2010 | Okamoto et al. | 336/65 |
| 2011/0156853 | A1* | 6/2011 | Kato et al. | 336/192 |
| 2012/0092120 | A1* | 4/2012 | Yoshikawa et al. | 336/220 |

FOREIGN PATENT DOCUMENTS

| | | | |
|---|---|---|---|
| JP | A-2004-193322 | | 7/2004 |
| JP | A-2006-351675 | | 12/2006 |
| JP | A-2007-129149 | | 5/2007 |
| JP | 2008-305854 | * | 12/2008 |
| JP | A-2008-305854 | | 12/2008 |
| JP | A-2009-194198 | | 8/2009 |
| JP | A-2009-267197 | | 11/2009 |
| JP | A-2010-45109 | | 2/2010 |
| JP | A-2010-50498 | | 3/2010 |
| JP | A-2010-118503 | | 5/2010 |
| JP | A-2011-078217 | | 4/2011 |
| WO | WO 2007/108201 | A1 | 9/2007 |
| WO | WO 2008/093492 | A1 | 8/2008 |
| WO | WO 2010-021113 | * | 2/2010 |

OTHER PUBLICATIONS

Written Opinion issued in International Application No. PCT/JP2011/001553 dated Jun. 14, 201.

International Preliminary Report on Patentability issued in International Application No. PCT/JP2011/001553 dated Nov. 6, 2012.

Nov. 27, 2013 Office Action issued in Japanese Patent Application No. 2010-243041 (with translation).

* cited by examiner

REACTOR

TECHNICAL FIELD

The present invention relates to a reactor used as a constituent part of a power conversion apparatus such as a vehicular DC-DC converter mounted in a vehicle such as a hybrid automobile. In particular, the present invention relates to a reactor that is compact and has excellent heat dissipation performance.

BACKGROUND ART

A reactor is one of the parts of a circuit that operates so as to raise and lower a voltage. For example, Patent Document 1 discloses a reactor used in a converter that is mounted in a vehicle such as a hybrid automobile. This reactor includes a coil, an annular magnetic core on which the coil is disposed, a case for housing an assembly constituted by the coil and the magnetic core, and sealing resin that fills the case. This reactor is generally used while fixed to a cooling base in order to cool the coil and the like that generate heat when power is supplied.

The above case is typically a die cast part made of aluminum, and is fixed to the cooling base and used as a heat dissipation path for releasing heat from the coil and the like.

CITATION LIST

Patent Documents

Patent Document 1: JP 2010-050498A

DISCLOSURE OF INVENTION

Problem to be Solved by the Invention

Recent years have seen a demand for further reductions in the size and weight of parts mounted in vehicles such as hybrid automobiles. However, it is difficult to further reduce the size of reactors that include a conventional aluminum case.

Aluminum is an electrically-conductive material, and therefore needs to be electrically insulated from at least the coil. Accordingly, a relatively large gap is normally provided between the coil and the inner faces of the case (bottom face and side wall faces) in order to ensure an electrical insulation distance. Ensuring this insulation distances makes a reduction in size difficult.

For example, the size of the reactor can be reduced by omitting the case. However, since the coil and the magnetic core will be exposed, it is not possible to achieve mechanical protection in terms of strength, protection from the outside environment, such as the accumulation of dust on and erosion of the coil and the magnetic core, and so on. Also, there is demand for the sealing resin that fills the case to have excellent heat dissipation performance. For example, heat dissipation performance is improved when a resin that contains a filler such as a ceramic is used as the sealing resin. However, since the external shape formed by the assembly constituted by the coil and the magnetic core is a complicated shape, it is time-consuming to fill the case with the filler-containing resin such that no gaps or voids are formed between the assembly and the inner faces of the case, and thus the reactor yield is poor. Also, although the heat dissipation performance can be improved by raising the content percentage of the filler in the sealing resin, the sealing resin becomes brittle, and thus is more easily damaged by thermal shock. Accordingly, there is demand for the development of a reactor that has excellent heat dissipation performance without using a sealing resin that contains a filler.

In view of this, an object of the present invention is to provide a reactor that has excellent heat dissipation performance while being compact.

Means for Solving Problem

The present invention achieves the above object through a configuration in which the case has a segmentalized structure, and a heat dissipation layer having excellent heat dissipation performance is provided at a place that configures an inner bottom face of the case.

The present invention pertains to a reactor that includes an assembly that has a coil and a magnetic core on which the coil is disposed, and a case that houses the assembly. The case includes an installation face portion that can be fixed to a fixing target when the reactor is installed on the fixing target; a side wall portion that is removably attached to the installation face portion and surrounds the periphery of the assembly; and a heat dissipation layer that is formed on an inner face of the installation face portion and is interposed between the installation face portion and the coil. Also, the thermal conductivity of the installation face portion is greater than or equal to the thermal conductivity of the side wall portion, and the heat dissipation layer is constituted by an insulating material whose thermal conductivity exceeds 2 W/m·K. The term "insulating" in the above insulating material refers to having a withstand voltage characteristic to the extent that electrical insulation can be achieved between the coil and the installation face portion.

According to the above configuration, the faces of the coil that are on the installation side when the reactor is disposed on the fixing target are in contact with the heat dissipation layer, and therefore heat from the coil can be efficiently transmitted to the heat dissipation layer and dissipated to the fixing target, such as a cooling base, via the heat dissipation layer, thus achieving excellent heat dissipation performance. In particular, since the heat dissipation layer is constituted by an insulating material, even if the installation face portion is constituted from an electrically-conductive material, the coil is brought into contact with the heat dissipation layer, and therefore the coil and the installation face portion can be reliably insulated from each other. Accordingly, the heat dissipation layer can be reduced in thickness, and in view of this point as well, heat from the coil is readily dissipated to the fixing target, and the reactor of the present invention has excellent heat dissipation performance. Also, the installation face portion is constituted from at least a material whose thermal conductance is greater than or equal to the thermal conductivity of the side wall portion, and therefore heat from the installation-side faces of the coil can be efficiently dissipated via the heat dissipation layer, and the reactor of the present invention has excellent heat dissipation performance. In particular, since the installation face portion and the side wall portion are separate members, they can be formed from different materials, and the reactor can have even more excellent heat dissipation performance if, for example, the installation face portion is made from a material whose thermal conductivity is higher than that of the side wall portion.

Also, when the heat dissipation layer is reduced in thickness as described above, the gap between the installation-side faces of the coil and the inner face of the installation face portion can be reduced, and the reactor can be reduced in size. Furthermore, according to the above configuration, the constituent materials of the installation face portion and the side wall portion can be easily changed since they are separate members. For example, if the side wall portion is made of a material that has excellent electrical insulation performance, the gap between the outer peripheral faces of the coil and the inner peripheral faces of the side wall portion can be reduced, thus enabling a further reduction in size.

Additionally, according to the above configuration, the heat dissipation layer is provided, and therefore heat can be efficiently dissipated at least from the installation-side faces of the coil via the heat dissipation layer as described above, and therefore in the case of a mode in which the case is filled with a sealing resin, for example, the heat dissipation performance achieved by the heat dissipation layer is improved even when using a resin whose thermal conductance is poor. Therefore, according to the above configuration, there is an improvement in the degree of freedom in the selection of sealing resins that can be used. For example, a resin that does not contain a filler can be used. Alternatively, even with a mode in which sealing resin is not provided, sufficient heat dissipation performance can be ensured with the heat dissipation layer.

Additionally, according to the above configuration, the installation face portion and the side wall portion are separate detachable members, and therefore the heat dissipation layer can be formed while the side wall portion is detached. Here, also with conventional cases that are not segmentalizable since the bottom face and the side walls are formed integrally, a heat dissipation layer can be formed on the inner bottom face that can come into contact with the coil, for example. However, in this case, the heat dissipation layer is not easy to form due to hindrance by the inner walls. In contrast, according to the above configuration, the heat dissipation layer can be easily formed, and the reactor has an excellent yield. Also, according to the above configuration, the case is provided, thus enabling achieving mechanical protection and protection of the coil and the magnetic core from the environment.

Furthermore, if the installation face portion and the side wall portion are separate members, there is no longer a need for the entirety of a resin mold body replacing the case to be configured by a highly heat-resistant thermosetting resin as with conventional structures in which the assembly and the installation face portion are integrated with a resin mold body. Accordingly, the case can be manufactured through ordinary resin molding using a thermoplastic resin, for example, it is possible to shorten the molding time, eliminate the need for special manufacturing equipment such as a transfer molding apparatus, reduce the space required for production, and so on, and it is possible to achieve a further reduction in manufacturing cost.

According to one mode of the present invention, the heat dissipation layer has a multi-layer structure constituted by an insulating adhesive, and the installation face portion is constituted by an electrically-conductive material.

The heat dissipation layer is constituted from an insulating adhesive, and therefore adhesion between the coil and the heat dissipation layer is improved. Also, the heat dissipation layer has a multi-layer structure, and therefore electrical insulation performance is improved even if the thickness-per-layer of the adhesive layers is low. Here, if the thickness of adhesive layers is made as low as possible, the distance between the coil and the installation face portion can be shortened, thus making it possible to reduce the size of the reactor. However, if the thickness of the adhesive layers is reduced, there is the risk of pin holes being present. In contrast, with a multi-layer structure, pin holes in one layer can be obstructed by another adjacent layer, thus making it possible to obtain a heat dissipation layer that has excellent insulation performance. The thickness-per-layer and the number of layers can be appropriately selected, and the higher the total thickness, the greater the insulation performance is improved, and the lower the total thickness, the greater the heat dissipation performance is improved. If a material having excellent insulation performance is used, sufficient heat dissipation performance and insulation performance can be achieved even if the adhesive layers are thin and the number of stacked layers is low. For example, it is possible to obtain a heat dissipation layer whose total thickness is less than 2 mm, furthermore less than or equal to 1 mm, and particularly less than or equal to 0.5 mm. On the other hand, when the installation face portion is constituted by an electrically-conductive material, which is typically a metal such as aluminum, the heat dissipation performance of the reactor is further improved since such metals ordinarily have excellent heat dissipation performance. Also, even if the installation face portion is constituted by an electrically-conductive material, the heat dissipation layer is constituted by an insulating material as described above, and therefore it is possible to ensure electrical insulation between the coil and the installation face portion.

According to another mode of the present invention, the side wall portion is constituted by an insulating material.

Similarly to the installation face portion described above, the side wall portion can also be constituted by an electrically-conductive material such as aluminum. In this case, the heat dissipation performance is improved. On the other hand, if the side wall portion is constituted by an insulating material, the side wall portion and the coil are insulated, thus making it possible to narrow the gap between the inner faces of the side wall portion and the outer peripheral faces of the coil, and achieve a further reduction in size. Also, if the insulating material is a material that is lighter than a metallic material, such as a resin, it is possible to obtain a case that is lighter than conventional aluminum cases.

According to another mode of the present invention, the heat dissipation layer has a multi-layer structure constituted by an epoxy-based adhesive that contains an alumina filler, the installation face portion is constituted by aluminum or an aluminum alloy, and the side wall portion is constituted by an insulating resin.

The epoxy-based adhesive containing an alumina filler has both excellent insulation performance and excellent heat dissipation performance, and has a thermal conductivity of 3 W/m·K or greater. Accordingly, the above mode enables more excellent heat dissipation performance. Also, if a multi-layer structure is applied, it is possible to ensure high electrical insulation performance even when the thickness of the adhesive layers is reduced as described above. Furthermore, if the thickness of the adhesive layers is reduced, it is possible to reduce the size of the reactor as described above. Furthermore, aluminum and aluminum alloys have a high thermal conductivity (aluminum: 237 W/m·K). Therefore, according to the above mode in which the installation face portion made of aluminum or the like is provided, heat from the coil can be efficiently dissipated to a fixing target such as a cooling base using the installation face portion as the heat dissipation path, thus achieving more excellent heat dissipation performance. Also, according to the above mode in which the side wall portion made of an insulating resin is provided, the gap between the coil and the side wall portion can be narrowed as described above, thus making it possible to obtain an even more compact reactor.

According to another mode of the present invention, the side wall portion is constituted by an insulating material, and the side wall portion is provided with a terminal block that fixes a terminal clamp for connection to the coil.

According to the above mode, the terminal clamp can be fixed to the side wall portion without the risk of a short circuit. Also, when the terminal clamp is positioned and fixed with the terminal block, and the side wall portion is attached to the assembly, it is possible to easily and reliably position the terminal clamp and the coil of the assembly. Also, when the terminal clamp is fixed to the side wall portion, and the side wall portion is fixed to the assembly, the terminal clamp and the coil can be maintained in a state of contact without welding. Accordingly, in the case where a connection fault occurs between the terminal clamp and the coil of the assembly due to some sort of cause, it is possible to detach only the terminal clamp from the side wall portion and replace it, and it is possible to reduce loss due to waste.

According to another mode of the present invention, a contact piece portion is formed so as to be raised up on the terminal clamp for connection to the coil, and the contact piece portion is brought into contact with a portion of the coil that protrudes out from the side wall portion.

According to the above mode, the contact piece portion of the terminal clamp is overlapped with the coil, and therefore the terminal clamp and the coil can be easily brought into contact. Also, since the terminal clamp and the coil are in contact with each other in the state of protruding out from the side wall portion, it is possible to facilitate access during welding or soldering.

According to another mode of the present invention, the reactor includes a closure member that is made of a resin and covers the contact piece portion of the terminal clamp and the portion of the coil that protrudes out from the side wall portion. This enables the portion of contact between the coil and the terminal clamp to be more reliably insulated from the outside.

According to another mode of the present invention, the side wall portion is constituted by an insulating material, and the side wall portion is provided with a positioning projection portion that comes into contact with the assembly and positions the assembly within the side wall portion.

According to the above mode, the assembly is brought into contact with the positioning projection portion that the side wall portion is provided with, and therefore the assembly can be easily and accurately positioned within the case. As a result, in the case of a mode in which the case is filled with a sealing resin, it is possible to accurately set the thickness dimension of the sealing resin as well, and to stably obtain a desired strength and heat dissipation effect. Also, in the case of a mode in which the terminal clamp is fixed to the side wall portion, the positioning of the terminal clamp and the coil of the assembly can also be easily and accurately performed.

According to another mode of the present invention, a housing groove is formed in an outer peripheral portion of the side wall portion that overlaps with the installation face portion, and a gap between the side wall portion and the installation face portion is sealed by a sealing member housed in the housing groove. According to this, in the case where a sealing resin is poured in between the case and the assembly, it is possible to more reliably prevent the leakage of the sealing resin from between the side wall portion and the installation face portion.

Effects of the Invention

A reactor of the present invention is compact and has excellent heat dissipation performance.

MODE FOR CARRYING OUT THE INVENTION

Figure 1:
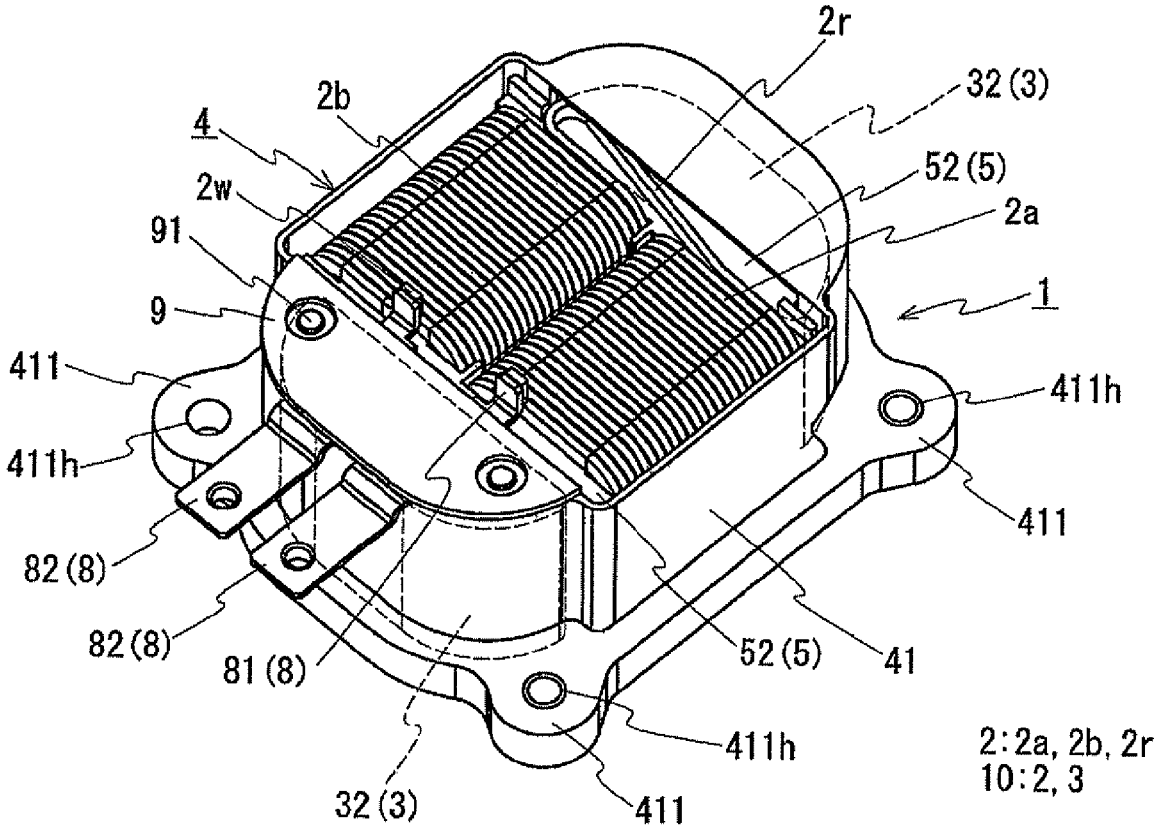
FIG. 1 is a schematic perspective diagram showing a reactor according to an embodiment.

Hereinafter, an embodiment of the present invention will be described with reference to FIGS. 1 to 5. Elements having the same name are denoted by the same reference signs throughout the drawings. Note that it is assumed in the following description that the lower side is the installation side when the reactor is installed, and that the upper side is the opposing side.

<<Overall Configuration>>

A reactor 1 includes an assembly 10 constituted by a coil 2 and a magnetic core 3 on which the coil 2 is disposed, and a case 4 that houses the assembly 10. The case 4 is a box that has one open face, and is typically filled with a sealing resin (not shown). The assembly 10 is embedded in the sealing resin with the exception of the end portions of a winding wire 2*w* that forms the coil 2. A feature of the reactor 1 is that the case 4 has a segmentable configuration. These constituent members will be described in further detail below.

<<Assembly>>

[Coil]

The coil 2 will now be described with reference to FIGS. 2 and 3 as appropriate. The coil 2 includes a pair of coil elements 2*a* and 2*b* formed by winding one continuous winding wire 2*w* having no bonded portion in a spiral, and a coil joining portion 2*r* that joins the coil elements 2*a* and 2*b*. The coil elements 2*a* and 2*b* have the same number of turns, and their shape as viewed from the axial direction (end face shape) is substantially rectangular. The coil elements 2*a* and 2*b* are aligned horizontally such that their axial directions are parallel, and part of the winding wire 2*w* on the other end side of the coil 2 (the back side with respect to the paper plane in FIG. 2) is bent into a U shape so as to form the coil joining portion 2*r*. According to this configuration, the winding directions of the coil elements 2*a* and 2*b* are the same.

Favorably, the winding wire 2*w* is a coated wire that includes an insulating coating made of an insulating material around a conductor made of an electrically-conductive material such as copper or aluminum. Here, a coated rectangular wire is used, and this coated rectangular wire has a conductor made of a copper rectangular wire, and an insulating coating made of an enamel (typically a polyamide-imide). Preferably, the thickness of the insulation coating is in the range of 20 μm to 100 μm inclusive, and the thicker it is, the further the number of pinholes can be reduced, thus improving the electrical insulation performance. The coil elements 2*a* and 2*b* are formed by winding the coated rectangular wire edgewise into a hollow rectangular tube shape. Besides being made of a rectangular wire, the conductor of the winding wire 2*w* can have various types of cross-sectional shapes, such as a circular shape, an elliptical shape, and a polygonal shape. A coil having a high space factor is easier to form when using a rectangular wire than when using a round wire whose cross-section is circular. Note that a mode is possible in which the coil elements are manufactured as separate winding wires, and the end portions of the winding wires forming the coil elements are joined by welding or the like so as to form a one-piece coil.

Figure 2:
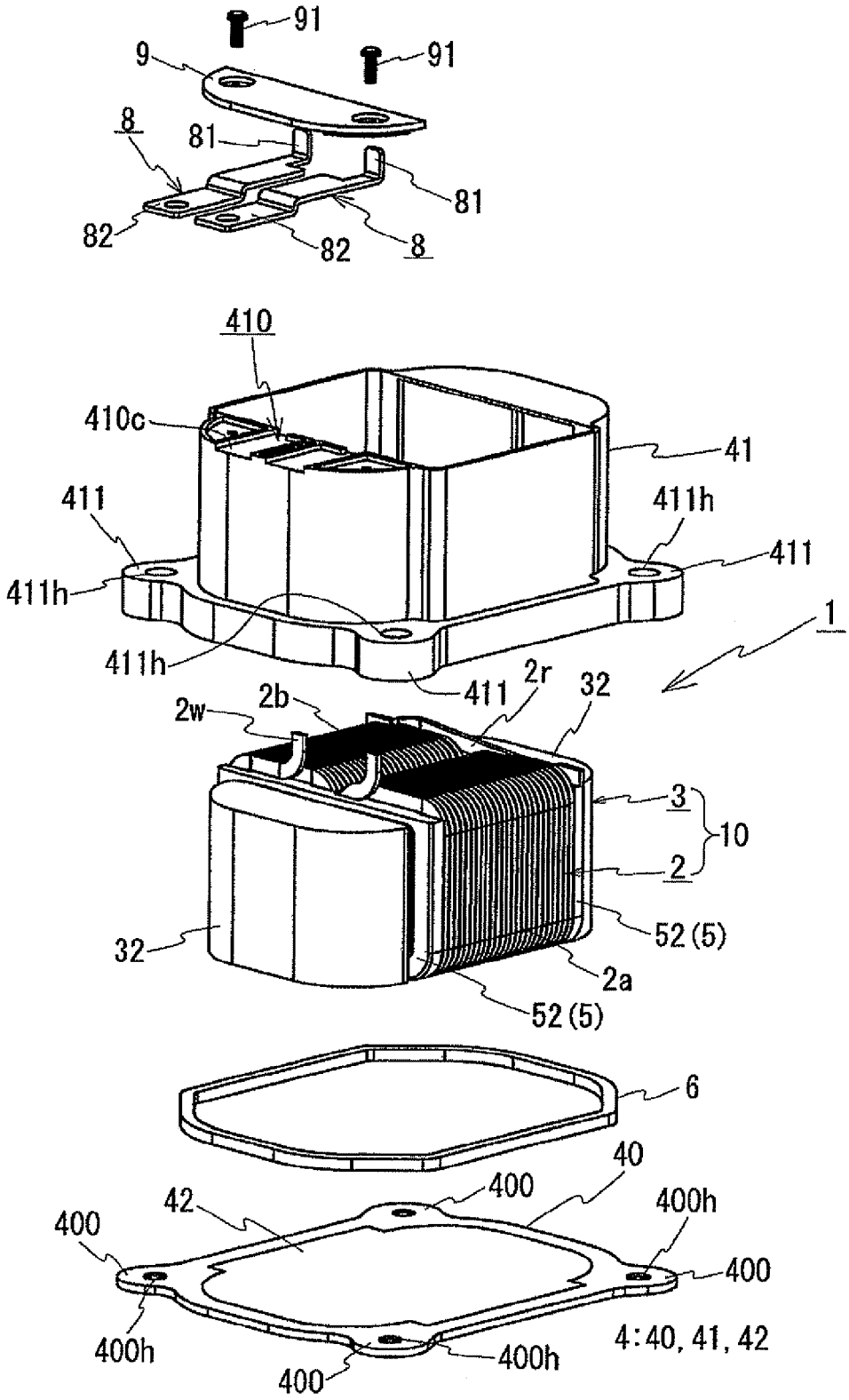
FIG. 2 is an exploded perspective diagram showing an overview of the reactor according to the embodiment.
Figure 3:
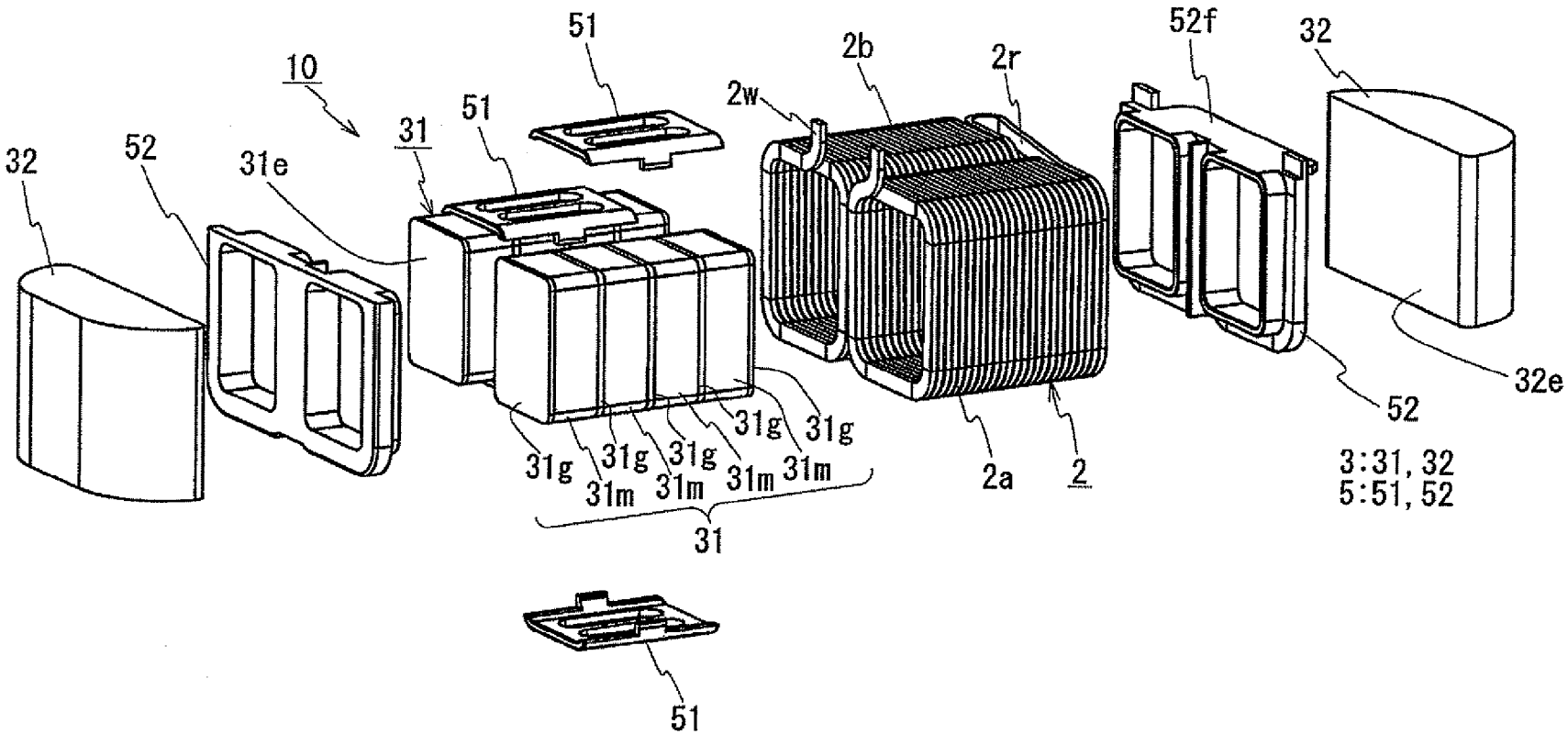
FIG. 3 is an exploded perspective diagram showing an overview of an assembly that is constituted by a coil and a magnetic core and is included in the reactor according to the embodiment.

The two end portions of the winding wire 2*w* that forms the coil 2 are drawn out to the outside of the case 4 (FIG. 1) by being appropriately drawn out from turn forming portions on one end side of the coil 2 (the front side with respect to the paper plane in FIG. 2). The drawn out end portions of the winding wire 2*w* have conductor portions that are exposed due to the insulating coating being peeled off, and terminal clamps 8 made of an electrically-conductive material are connected to these conductor portions. The coil 2 is connected via these terminal clamps 8 to an external apparatus (not shown) such as a power supply for supplying power to the coil 2. Details of the terminal clamps 8 will be described later.

[Magnetic Core]

The magnetic core 3 will now be described with reference to FIG. 3 as appropriate. The magnetic core 3 has a pair of inner core portions 31 on which the coil elements 2*a* and 2*b* are respectively disposed, and a pair of outer core portions 32 that do not have the coil 2 disposed thereon and are exposed outside the coil 2. Here, the inner core portions 31 each have a cuboid shape, and the outer core portions 32 are each a prismatic body having a pair of trapezoidal faces. The outer core portions 32 are disposed so as to sandwich the inner core portions 31, which are disposed with a space therebetween, and end faces 31*e* of the inner core portions 31 are brought into contact with inner end faces 32*e* of the outer core portions 32, and thus the magnetic core 3 is formed so as to be annular. A closed magnetic circuit is formed by the inner core portions 31 and the outer core portions 32 when the coil 2 is excited.

The inner core portions 31 are each a laminate formed by alternately laminating core pieces 31*m* made of a magnetic material and gap members 31*g* typically made of a non-magnetic material, and the outer core portions 32 are each a core piece made of a magnetic material. The core pieces can each be a compact formed using a magnetic powder, or a laminate formed by laminating multiple magnetic thin plates (e.g., magnetic steel plates) that have an insulating coating film.

Examples of the aforementioned compact include: a powder compact formed using a powder made of an iron group metal such as Fe, Co, or Ni, an Fe base alloy such as Fe—Si, Fe—Ni, Fe—Al, Fe—Co, Fe—Cr, or Fe—Si—Al, a rare earth metal, or a soft magnetic material such as an amorphous magnetic body; a sintered body formed by subjecting one of the above powders to press molding and then sintering; and a molded hardened body formed by subjecting a mixture of one of the above powders and a resin to injection molding, cast molding, or the like. Other examples of the core piece include a ferrite core, which is a sintered body made of a metal oxide. In the case of a compact, magnetic cores having various three-dimensional shapes can be easily formed.

In the case of a powder compact, a compact that includes an insulating coating film on the surface of a powder made of the above-described soft magnetic material can be favorably used, and in this case, the compact is obtained by molding that powder and then performing baking at a temperature that is less than or equal to the heat resistance temperature of the insulating coating film. Typical examples of the insulating coating film include a film made of silicone resin or phosphate.

A mode is possible in which the inner core portions and the outer core portions are formed from different materials. For example, if the inner core portions are powder compacts or laminated bodies, and the outer core portions are molded hardened bodies, it is easy to set the saturation magnetic flux density of the inner core portions higher than that of the outer core portions. Here, the core pieces are powder compacts made of a soft magnetic powder that contains iron, steel, or the like.

The gap members 31*g* are plate-shaped members disposed in the gaps provided between the core pieces 31*m* in order to adjust the inductance, and are constituted by a material that has a lower permeability than the core pieces (typically a non-magnetic material), such as alumina or glass epoxy resin, or unsaturated polyester (there are also cases of air gaps).

The number of core pieces and gap members can be appropriately selected such that the reactor 1 has a desired inductance. Also, the shape of the core pieces and gap members can be appropriately selected.

Additionally, insulation performance between the coil 2 and the inner core portions 31 is improved if a configuration is applied in which a covering layer made of an insulating material is provided on the outer periphery of the inner core portions 31. The covering layer is provided by disposing a heat shrinkable tube, an ordinary temperature shrinkable tube, an insulating tube, insulating paper, or the like. The shrinkable tube is disposed on the outer periphery of the inner core portions 31 and affixed with insulating tape or the like, thus integrating the core pieces and the gap members in addition to improving insulation performance.

With the magnetic core 3, the installation-side faces of the inner core portions 31 and the installation-side faces of the outer core portions 32 are not flush. Specifically, when the reactor 1 is installed on a fixing target, the installation-side faces of the outer core portions 32 (referred to hereinafter as the core installation faces, which are the lower faces in FIG. 3) protrude out farther than the installation-side faces of the inner core portions 31. Also, the height of the outer core portions 32 (which is, when the reactor 1 is installed on a fixing target, the length in the direction perpendicular to the surface of the fixing target (here, the direction orthogonal to the axial direction of the coil 2, which is the up-down direction in FIG. 3)) is adjusted such that the core installation faces of the outer core portions 32 are flush with the installation-side faces of the coil 2 (referred to hereinafter as the coil installation faces, which are the lower faces in FIG. 3). Accordingly, the magnetic core 3 is H-shaped in a transparent view from a side face when the reactor 1 is installed. Also, since the core installation faces and the coil installation faces are flush, not only the coil installation faces of the coil 2, but also the core installation faces of the magnetic core 3 can come into contact with a later-described heat dissipation layer 42 (FIG. 2). Furthermore, when the magnetic core 3 is assembled into an annular shape, the side faces of the outer core portions 32 (the front and back faces with respect to the paper plane in FIG. 3) protrude outward farther than the side faces of the inner core portions 31. Accordingly, the magnetic core 3 is H-shaped also in a transparent view from the upper face or the lower face when the reactor 1 is installed (when the lower side in FIG. 3 is the installation side). The magnetic core 3 having such a three-dimensional shape can be easily formed by using powder compacts, and furthermore the portions of the outer core portions 32 that protrude out farther than the inner core portions 31 can also be used as the magnetic flux path.

[Insulator]

The assembly 10 includes an insulator 5 between the coil 2 and the magnetic core 3, thus improving insulation performance between the coil 2 and the magnetic core 3. The insulator 5 is configured including bobbins disposed on the outer periphery of the inner core portions 31 and a pair of frame-shaped portions 52 that are in contact with the end faces of the coil 2 (the faces where the turns of the coil elements appear to be annular), for example.

Figure 6:
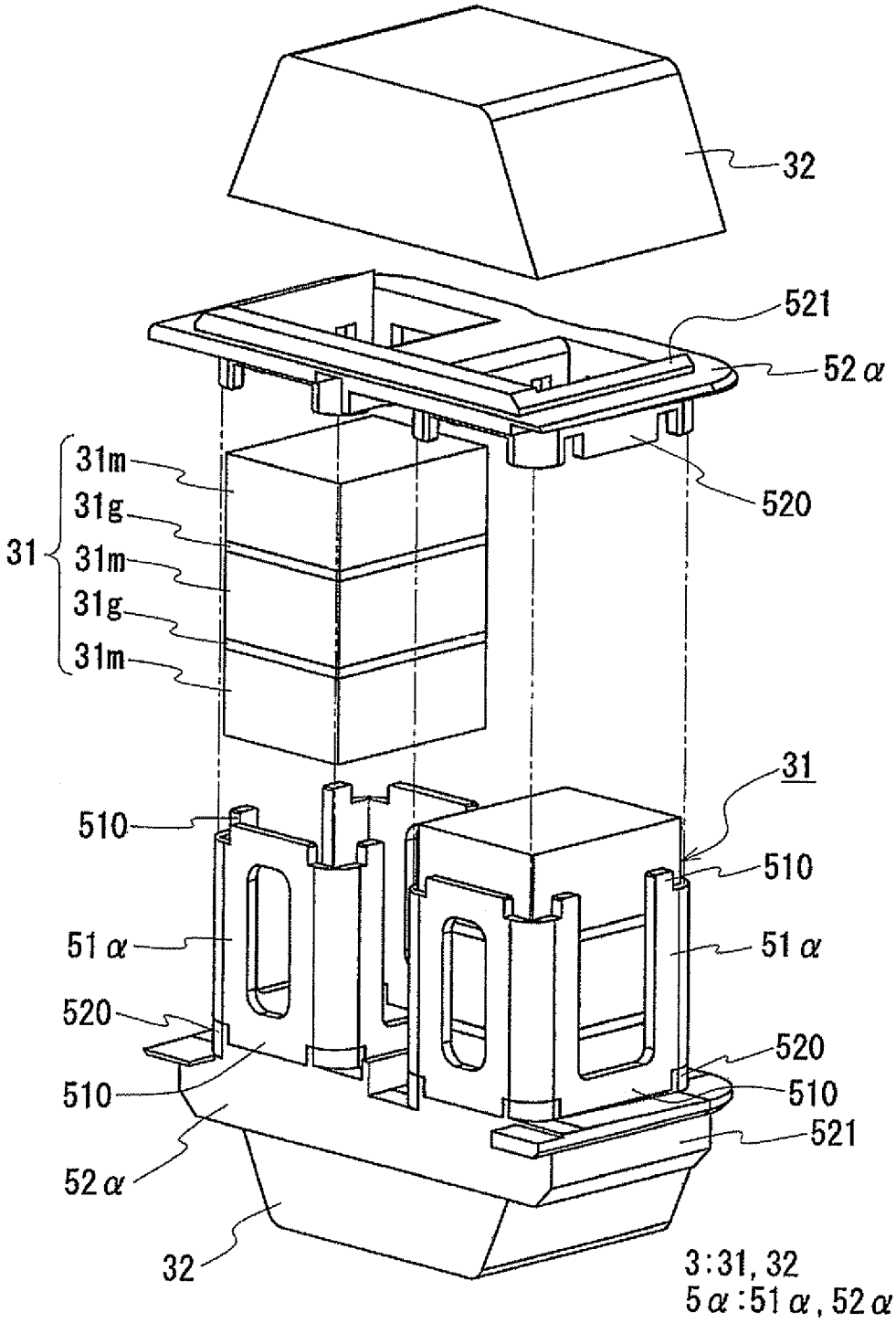
FIG. 6 is an exploded perspective diagram showing an overview of another mode of the assembly constituted by the coil and the magnetic core.

Here, each bobbin is configured by a pair of bobbin pieces 51 that have "]" shaped cross-sections, and is configured so as to be disposed on only a portion of the outer peripheral face of the inner core portion 31, without the bobbin pieces 51 being in contact with each other. Although the bobbin can be a tubular body that is disposed along the entire periphery of the outer peripheral face of the inner core portion 31 (see the later-described FIG. 6), a mode in which portions of the inner core portion 31 are not covered by the bobbin pieces 51 as shown in FIG. 3 is possible if an insulation distance can be ensured between the coil 2 and the inner core portion 31. Also, the bobbin pieces 51 used here include window portions that penetrate from the front surface to the rear surface.

The amount of material used for the bobbin can be reduced if portions of the inner core portion 31 are exposed from the bobbin. Also, in the case of a mode in which sealing resin is provided, if a configuration is applied in which the bobbin pieces 51 have the window portions, and the entire periphery of the inner core portion 31 is not covered by the bobbin pieces 51, the area of contact between the inner core portions 31 and the sealing resin can be increased, and air bubbles readily escape when pouring in the sealing resin, which is excellent in terms of the manufacturability of the reactor 1.

Each frame-shaped portion 52 is flat plate-shaped, has a pair of opening portions through which the inner core portions 31 are inserted, and includes a short tubular portion that protrudes toward the inner core portions 31 so as to facilitate the introduction of the inner core portions 31. Also, one of the frame-shaped portions 52 includes a flange portion 52*f* on which the coil joining portion 2*r* is placed in order to insulate the coil joining portion 2*r* from the outer core portion 32.

The constituent material of the insulator can be an insulating material such as polyphenylene sulfide (PPS) resin, polytetrafluoroethylene (PTFE) resin, or liquid crystal polymer (LOP).

<<Case>>

Figure 4:
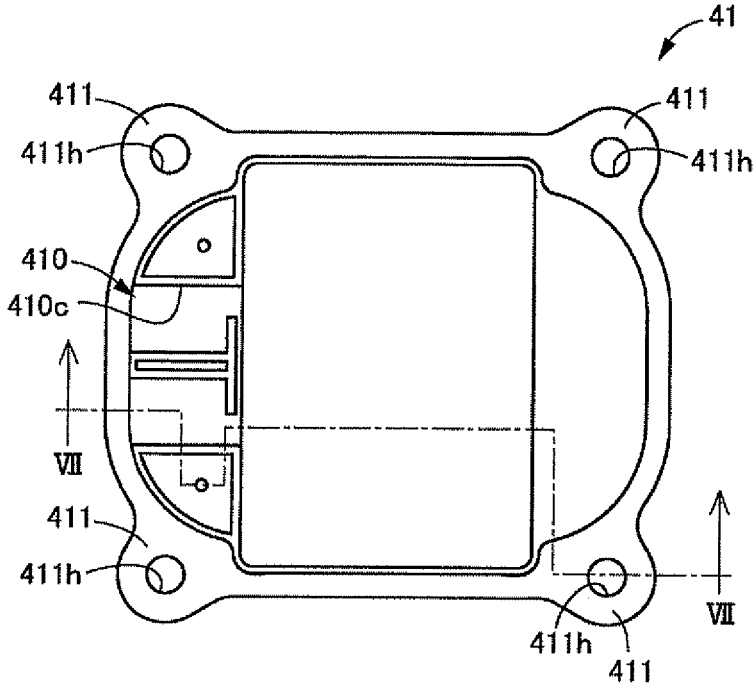
FIG. 4 is a top view of a side wall portion included in the reactor according to the embodiment.

The case 4 will now be described with reference to FIGS. 2, 4, and 5 as appropriate. The case 4, which houses the assembly 10 constituted by the coil 2 and the magnetic core 3, includes a flat plate-shaped installation face portion 40 and a frame-shaped side wall portion 41 that is provided upright on the installation face portion 40. The most prominent features of the reactor 1 are that the installation face portion 40 and the side wall portion 41 are detachable, and that the installation face portion 40 is provided with the heat dissipation layer 42.

[Installation Face Portion and Side Wall Portion]

(Installation Face Portion)

The installation face portion 40 is a rectangular plate that is fixed to a fixing target when the reactor 1 is to be installed on the fixing target. The heat dissipation layer 42 is formed on the face of the installation face portion 40 that is disposed on the inward side when the case 4 is assembled. Also, the installation face portion 40 has flange portions 400 that protrude out from the four corners, and the flange portions 400 are each provided with a bolt hole 400*h* for the insertion of a bolt (not shown) for fixing the case 4 to the fixing target. The bolt holes 400*h* are provided so as to be continuous with bolt holes 411*h* in the side wall portion 41 that are described below. The bolt holes 400*h* and 411*h* can be through-holes that are not provided with threading, or threaded holes that are provided with threading, and the number thereof and the like can be appropriately selected.

(Side Wall Portion)

The side wall portion 41 is a rectangular frame-shaped body having one opening portion that is obstructed by the installation face portion 40 and another opening portion that is free when the case 4 is assembled and the side wall portion 41 is disposed so as to surround the periphery of the assembly 10. Here, the region of the side wall portion 41 that is on the installation side when the reactor 1 is installed on a fixing target is in the shape of a rectangle that conforms to the outer shape of the installation face portion 40, and the region on the free opening side is in the shape of a curved face that conforms to the outer peripheral faces of the assembly 10 constituted by the coil 2 and the magnetic core 3. When the case 4 is assembled, the outer peripheral faces of the coil 2 and the inner peripheral faces of the side wall portion 41 are adjacent, and the gap between the outer peripheral faces of the coil 2 and the inner peripheral faces of the side wall portion 41 is extremely narrow at approximately 0 mm to 1.0 mm. Also, here, eave-shaped portions disposed so as to cover the trapezoidal faces of the outer core portions 32 of the assembly 10 are provided in the open-side region of the side wall portion 41, and when the assembly 10 is housed in the case 4, the coil 2 is exposed as shown in FIG. 1, and the magnetic core 3 is substantially covered by the constituent material of the case 4. Providing the eave-shaped portions makes it possible to improve resistance to vibration, improve the rigidity of the case 4 (side wall portion 41), and also achieve mechanical protection and protection of the assembly 10 from the outside environment. Note that the eave-shaped portions may be omitted.

Figure 5:
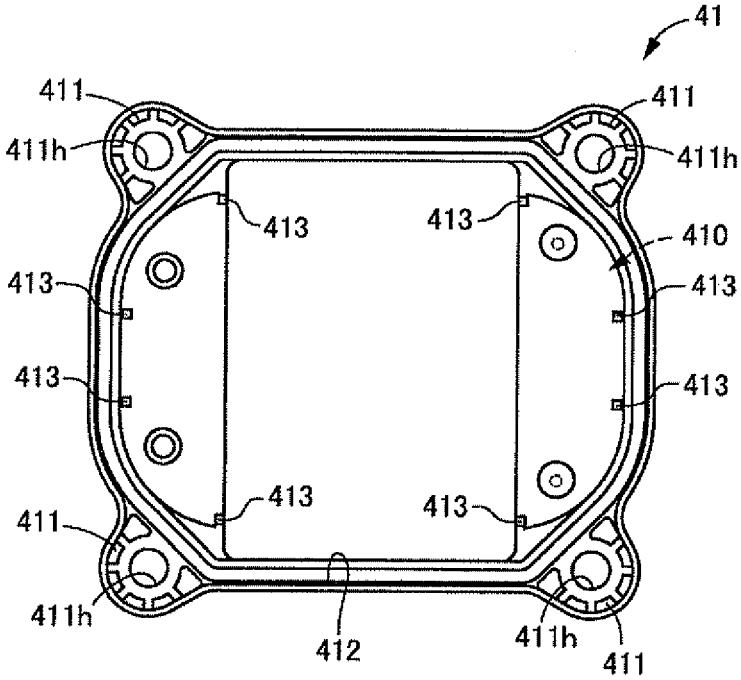
FIG. 5 is a bottom view of the side wall portion included in the reactor according to the embodiment.

Also, as shown in FIG. 5, a housing groove 412 that is open toward the installation face portion 40 and is continuous over the entire periphery is formed in the side wall portion 41 in the periphery of the opening portion on the installation face portion 40 side. Furthermore, multiple positioning projection portions 413 are integrally formed at appropriate positions on the inner peripheral faces of the side wall portion 41. The positioning projection portions 413 are ribs that project from the inner peripheral faces of the side wall portion 41 toward the interior of the side wall portion 41 and extend in the up-down direction of the side wall portion 41. In the present embodiment, the positioning projection portions 413 are formed on the inner peripheral faces of the assembly 10 that cover the two outer core portions 32 so as to sandwich the assembly 10 on both sides in two orthogonal directions in a top view.

[Terminal Block]

In the open-side region of the side wall portion 41, a portion that covers the top of one of the outer core portions 32 functions as a terminal block 410 to which the terminal clamps 8 are fixed.

As shown in FIG. 2, each terminal clamp 8 is a rectangular plate member that includes a welding face 81 serving as a contact piece portion that is connected to an end portion of the winding wire 2*w* that constitutes the coil 2, a connecting face 82 for connection with an external apparatus such as a power supply, and a joining portion that joins the welding face 81 and the connecting face 82, and as shown in FIG. 2, the terminal clamp 8 is bent into an appropriate shape. The welding face 81 is formed by bending an end portion of the terminal clamp 8 so as to form a projection that is raised substantially perpendicular to the connecting face 82. Besides welding such as TIG welding, it is possible to use crimping or the like to connect the conductor portion of the winding wire 2*w* and the terminal clamp 8. This shape of the terminal clamp 8 is one example thereof, and a terminal clamp 8 having an appropriate shape can be used.

Recessed grooves 410*c*, in which the joining portions of the terminal clamps 8 are disposed, are formed in the terminal block 410. When fitted in the recessed grooves 410*c*, the tops of the terminal clamps 8 are covered by a terminal fixing member 9, and the terminal clamps 8 are fixed to the terminal block 410 by constricting the terminal fixing member 9 with bolts 91. The constituent material of the terminal fixing member 9 can favorably be an insulating material such as the insulating resin used as the later-described constituent material of the case. Note that the terminal clamps 8 may be engaged with and positioned on the terminal block 410 by providing a cutout in the edge portions of the terminal clamps 8 and providing the terminal block 410 with projection portions that engage with the cutouts. Also, a mode is possible in which the terminal block is a separate member, and the separate terminal block is fixed to the side wall portion, for example. Also, in the case of forming the side wall portion from an insulating material such as that described later, a mode is possible in which the side wall portion, the terminal clamps, and the terminal block portion are integrated by forming the terminal clamps through insert molding.

[Attachment Locations]

Similarly to the installation face portion 40, the installation-side region of the side wall portion 41 includes flange portions 411 that protrude out from the four corners, and the bolt hole 411*h* is provided in each flange portion 411. The bolt holes 411*h* may be formed by only the constituent material of the side wall portion 41, or may be formed by disposing a tube made of another material. For example, in the case of constituting the side wall portion 41 from resin, if the tubes are metal tubes made of a metal such as brass, steel, or stainless steel, excellent strength is achieved, thus enabling suppressing creep deformation of the resin. Here, the bolt holes 411*h* are formed by disposing metal tubes.

(Materials)

If the constituent material of the case 4 is a metallic material, for example, the case can have excellent heat dissipation performance since metallic materials generally have a high thermal conductivity. Specific examples of this metal include aluminum and alloys thereof, magnesium (thermal conductivity: 156 W/m·K) and alloys thereof, copper (390 W/m·K) and an alloy thereof, silver (427 W/m·K) and alloys thereof, and iron or austenite-based stainless steel (e.g., SUS304: 16.7 W/m·K). When aluminum, magnesium, or an alloy thereof is used, the case can be lightweight, and it possible to contribute to a reduction in the weight of the reactor. In particular, aluminum or an alloy thereof can be favorably used for vehicle-mounted parts due to also having excellent corrosion resistance. In the case of forming the case 4 from a metallic material, the case 4 can be formed by casting such as die casting, or plastic working such as press working.

Alternatively, if the constituent material of the case 4 is a non-metallic material such as resin like polybutylene terephthalate (PBT) resin, urethane resin, polyphenylene sulfide (PPS) resin, or acrylonitrile butadiene styrene (ABS) resin, insulation performance between the coil 2 and the case 4 is improved since these non-metallic materials generally often also have excellent electrical insulation performance. Also, these non-metallic materials are lighter than the above-described metallic materials, thus making it possible to reduce the weight of the reactor 1. In the case of a mode in which a later-described filler made of a ceramic is mixed with the resin, the heat dissipation performance can be improved. In the case where the case 4 is formed from resin, injection molding can be favorably used.

The constituent materials of the installation face portion 40 and the side wall portion 41 can be the same type of material. In this case, their thermal conductivities are the same. Alternatively, given that the installation face portion 40 and the side wall portion 41 are separate members, they can be formed from different constituent materials. In this case, if the constituent materials thereof are selected such that, in particular, the thermal conductivity of the installation face portion 40 is higher than the thermal conductivity of the side wall portion 41, heat from the coil 2 and the magnetic core 3 disposed on the installation face portion 40 can be efficiently dissipated to a fixing target such as a cooling base. Here, the installation face portion 40 is constituted by aluminum, and the side wall portion 41 is constituted by PBT resin.

(Joining Method)

Various types of procedures can be used to integrally connect the installation face portion 40 and the side wall portion 41. For example, it is possible to use an appropriate adhesive, or use fastening members such as bolts. Here, the installation face portion 40 and the side wall portion 41 are integrated by being respectively provided with the bolt holes 400*h* and 411*h*, and screwing in bolts (not shown).

[Heat Dissipation Layer]

The installation face portion 40 includes the heat dissipation layer 42 at the location where the installation face portion 40 comes into contact with the coil installation faces of the coil 2 and the core installation faces of the outer core portions 32. The heat dissipation layer 42 is constituted from an insulating material having a thermal conductivity exceeding 2 W/m·K. The higher the thermal conductivity of the heat dissipation layer 42, the more preferable it is, and it is preferable that the heat dissipation layer 42 is constituted by a material having a thermal conductivity of 3 W/m·K or higher, particularly 10 W/m·K or higher, more particularly 20 W/m·K or higher, and even more particularly 30 W/m·K or higher. In the case of filling the case 4 with a sealing resin, it is preferable that the thermal conductivity of the heat dissipation layer 42 is higher than the thermal conductivity of the sealing resin.

Specific examples of the constituent material of the heat dissipation layer 42 include a non-metallic inorganic material such as a ceramic, such as one material selecting from among a metal element or Si oxide, carbide, and nitride. More specific examples of a ceramic include silicon nitride ($Si_3N_4$): approximately 20 W/m·K to 150 W/m·K; alumina ($Al_2O_3$): approximately 20 W/m·K to 30 W/m·K; aluminum nitride (AlN): approximately 200 W/m·K to 250 W/m·K; boron nitride (BN): approximately 50 W/m·K to 65 W/m·K; and silicon carbide (SiC): approximately 50 W/m·K to 130 W/m·K. These ceramics have excellent electrical insulation performance in addition to having excellent heat dissipation performance. In the case of forming the heat dissipation layer 42 from one of the above-described ceramics, a vapor deposition method such as a PVD method or a CVD method can be used, for example. Alternatively, the heat dissipation layer 42 can be formed by preparing a sintered plate of one of the above-described ceramics and bonding it to the installation face portion 40 using an appropriate adhesive.

Another example of the constituent material of the heat dissipation layer 42 is an insulating resin that contains a filler made of one of the above-described ceramics. Examples of the insulating resin include epoxy resin and acrylic resin. If the insulating resin contains a filler having excellent heat dissipation performance and electrical insulation performance, it is possible to constitute a heat dissipation layer 42 that has excellent heat dissipation performance and electrical insulation performance. Also, even in the case of using a resin that contains a filler, the heat dissipation layer 42 can be easily formed by application of the resin to the installation face portion 40, for example. In the case where the heat dissipation layer 42 is constituted from an insulating resin, it is preferable that the adhesion between the coil 2 and the heat dissipation layer 42 is improved by using an adhesive, in particular. In the case of forming the heat dissipation layer 42 from the insulating resin, the heat dissipation layer 42 can be easily formed using screen printing for example.

Here, the heat dissipation layer 42 is formed from an epoxy-based adhesive that contains a filler made of alumina (thermal conductivity: 3 W/m·K). Also, here, the heat dissipation layer 42 has a two-layer structure including the adhesive layers, each layer of which has a thickness of 0.2 mm to give a total thickness of 0.4 mm. Note that in the case where the heat dissipation layer 42 has a multi-layer structure, the layers may be formed from the same material, or mutually different materials. The heat dissipation layer 42 may have any shape as long as it has a surface area that allows the coil installation faces and the core installation faces to be in sufficient contact with the heat dissipation layer 42. Here, the heat dissipation layer 42 has a shape that conforms to the shape formed by the coil installation faces of the coil 2 and the core installation faces of the outer core portions 32.

[Sealing Resin]

A mode is possible in which the case 4 is filled with a sealing resin (not shown) made of an insulating resin. In this case, the end portions of the winding wire 2*w* are drawn outside the case 4 so as to be exposed from the sealing resin. Examples of the sealing resin include epoxy resin, urethane resin, and silicone resin. Also, the heat dissipation performance can be further improved if the sealing resin contains a filler that has excellent insulation performance and thermal conductance, such as a filler made of at least one type of ceramic selected from among silicon nitride, alumina, aluminum nitride, boron nitride, mullite, and silicon carbide.

In the case where the case 4 is filled with a sealing resin, it is preferable that a packing 6 is disposed in order to prevent the leakage of unhardened resin from gaps between the installation face portion 40 and the side wall portion 41. Here, the packing 6 is an annular body that is large enough to be fitted on the outer periphery of the assembly 10 constituted by the coil 2 and the magnetic core 3, and although the packing 6 is constituted from synthetic rubber, it is possible to use any appropriate material.

<<Reactor Manufacturing>>

The reactor 1 having the above-described configuration can be manufactured as described below.

First, the assembly 10 constituted by the coil 2 and the magnetic core 3 is formed. Specifically, as shown in FIG. 3, the inner core portions 31 are formed by laminating the core pieces 31*m* and the gap members 31*g*, the bobbin pieces 51 of the insulator 5 are disposed on the outer periphery of the inner core portions 31, and then the inner core portions 31 are inserted in the coil elements 2*a* and 2*b*. The frame-shaped portions 52 and the outer core portions 32 are disposed on the coil 2 such that the end faces of the coil elements 2*a* and 2*b* and the end faces 31*e* of the inner core portions 31 are sandwiched by the frame-shaped portions 52 of the insulator 5 and the outer core portions 32, thus forming the assembly 10. The end faces 31*e* of the inner core portions 31 are exposed via the opening portions of the frame-shaped portions 52 and are in contact with the inner end faces 32*e* of the outer core portions 32.

Although the core pieces 31*m* and the gap members 31*g* may be integrated by being joined using an adhesive, tape, or the like, an adhesive is not used here. Also, although the pair of bobbin pieces 51 are not configured so as to engage with each other, they are inserted into the coil elements 2*a* and 2*b* together with the inner core portions 31, and then the outer core portions 32 are disposed, and therefore the bobbin pieces 51 are maintained in a state of being disposed between the inner peripheral faces of the coil elements 2*a* and 2*b* and the inner core portions 31, and do not fall out.

Meanwhile, the installation face portion 40 is formed by punching out a predetermined shape from an aluminum plate as shown in FIG. 2, and the heat dissipation layer 42 having a predetermined shape is formed on one face thereof by screen printing. The assembly 10 assembled as described above is then adhered onto the heat dissipation layer 42 so as to be fixed thereto. Constituting the heat dissipation layer 42 from an adhesive enables firmly fixing the assembly 10 to the installation face portion 40. Furthermore, since the core installation faces and the coil installation faces of the assembly 10 are flush as described above, substantially the entirety of the lower face of the assembly 10 can be adhered to the installation face portion 40 via only the heat dissipation layer 42. The packing 6 is disposed on the outer periphery of the assembly 10.

Then, the side wall portion 41 configured having a predetermined shape by injection molding or the like is placed over the assembly 10 so as to cover the outer peripheral faces of the assembly 10, and the installation face portion 40 and the side wall portion 41 are integrated by bolts (not shown) that are provided separately. At this time, the outer core portions 32 of the assembly 10 are covered and stopped by the terminal block 410 and the above-described eave-shaped portions, and therefore the assembly 10 can be prevented from falling out of the side wall portion 41. Also, the positioning projection portions 413 of the side wall portion 41 are brought into contact with the assembly 10, and therefore it is possible to prevent the external core portion 32 from falling out, and to position the assembly 10 within the side wall portion 41. With this process, the box-shaped case 4 is assembled as shown in FIG. 1, and the assembly 10 can be housed in the case 4. Note that the packing 6 is housed in the housing groove 412 of the side wall portion 41, and is compressed between the inner face of the housing groove 412 and the installation face portion 40. Accordingly, the gap between the side wall portion 41 and the installation face portion 40 is sealed by the packing 6, thus preventing the leakage of the sealing resin when the case 4 is filled with the sealing resin.

Subsequently, the terminal clamps 8 are fitted into the recessed grooves 410*c* (FIG. 2) of the terminal block 410 (FIG. 2) of the side wall portion 41, and the welding faces 81 of the terminal clamps 8 are overlapped with the end portions of the winding wire 2*w* protruding out from the opening portion of the case 4. The welding faces 81 of the terminal clamps 8 are then welded to the end portions of the winding wire 2*w* protruding out from the case 4. Access during welding can be facilitated since the end portions of the winding wire 2*w* and the welding faces 81 of the terminal clamps 8 project outside the case 4. Furthermore, the joining portions of the terminal clamps 8 are covered with the terminal fixing member 9, and the terminal fixing member 9 is fixed to the side wall portion 41 using the bolts 91, thus fixing the terminal clamps 8 to the terminal block 410. With this process, the reactor 1 is formed without providing sealing resin.

Then, the reactor 1 including sealing resin is formed by filling the case 4 with sealing resin (not shown) and then allowing the sealing resin to harden. Note that a mode is possible in which the terminal clamps 8 are fixed to the terminal block 410 using the bolts 91, the case 4 is filled with the sealing resin, and then the end portions of the winding wire 2*w* and the welding faces 81 of the terminal clamps 8 are welded. It should also be noted that regardless of whether the sealing resin is present, a mode is possible in which, for example, the end portions of the winding wire 2*w* and the welding faces 81 are maintained in a contacting state without being welded, through the side wall portion 41 to which the terminal clamps 8 are fixed and the assembly 10 being attached to each other. With this mode, if a contact failure occurs between the welding faces 81 and the winding wire 2*w* due to a failure in the formation of the terminal clamps 8, for example, it is possible to replace simply the terminal clamps 8, thus enabling reducing loss due to waste.

<<Effects>>

With the reactor 1 having the above-described configuration, the heat dissipation layer 42 having excellent thermal conductance (a thermal conductivity exceeding 2 W/m·K) is interposed between the installation face portion 40 and the coil 2, and therefore heat generated by the coil 2 and heat generated by the magnetic core 3 during use can be efficiently dissipated to the fixing target such as a cooling base via the installation face portion 40. Accordingly, the reactor 1 has excellent heat dissipation performance.

In particular, with the reactor 1, the installation face portion 40 is constituted by a material having excellent thermal conductance such as aluminum, and in view of this as well, heat can be efficiently dissipated from the heat dissipation layer 42 to the fixing target, thus achieving excellent heat dissipation performance. Also, with the reactor 1, although the installation face portion 40 is constituted by a metallic material (electrically-conductive material), the heat dissipation layer 42 is constituted by an insulating adhesive, thus enabling ensuring insulation performance between the coil 2 and the installation face portion 40 even when the heat dissipation layer 42 is very thin at 0.4 mm. In particular, more reliable insulation can be achieved by giving the heat dissipation layer 42 a multi-layer structure. In view of the fact that the heat dissipation layer 42 is thin in this way as well, heat from the coil 2 and the like is readily transmitted to the fixing target via the installation face portion 40, and the reactor 1 has excellent heat dissipation performance. Furthermore, since the heat dissipation layer 42 is constituted by an insulating adhesive, the coil 2 and the magnetic core 3 have excellent adhesion with the heat dissipation layer 42, and in view of this as well, heat from the coil 2 and the like is readily transmitted to the heat dissipation layer 42, and the reactor 1 has excellent heat dissipation performance. Also, in the case where sealing resin is provided, it is preferable that the thermal conductivity of the heat dissipation layer 42 is higher than the thermal conductivity of the sealing resin surrounding the assembly 10, and doing this enables heat from the coil 2 and the like to more actively be transmitted to the heat dissipation layer 42, and heat can be more effectively dissipated from the installation face portion 40. In particular, substantially the entirety of the lower face of the assembly 10 is adhered to the installation face portion 40 via only the heat dissipation layer 42 and not via the sealing resin, and in view of this as well, heat from the coil 2 and the like can be more actively transmitted to the installation face portion 40 than to the surrounding sealing resin.

Also, since the reactor 1 includes the case 4, it is possible to achieve mechanical protection and protection of the assembly 10 from the environment. Furthermore, even though the case 4 is provided, the reactor 1 is lightweight since the side wall portion 41 is constituted by a resin, and is compact since the gap between the outer peripheral faces of the coil 2 and the inner peripheral faces of the side wall portion 41 is narrow. Also, in view of the fact that the heat dissipation layer 42 is thin as described above as well, the gap between the coil installation faces of the coil 2 and the inner faces of the installation face portion 40 is narrow, and therefore the reactor 1 is compact.

Furthermore, the reactor 1 is configured such that the installation face portion 40 and the side wall portion 41 are separate members that are combined so as to be integrated, and therefore the heat dissipation layer 42 can be formed on the installation face portion 40 while the side wall portion 41 is detached. Accordingly, the heat dissipation layer 42 can be formed easily, and the reactor 1 has excellent yield. Also, since the installation face portion 40 and the side wall portion 41 are separate members, they can be formed from different materials, and therefore the range of constituent materials that can be selected is wider. Also, since heat can be effectively dissipated from the installation face portion 40, heat conditions in the periphery of portions of the assembly 10 other than the installation faces are loosened. Accordingly, a thermoplastic resin can be applied as the side wall portion 41, thus enabling easy manufacturing through a general manufacturing method that uses inexpensive materials.

{Variation 1}

Although a mode in which the installation face portion and the side wall portion are constituted by different materials is described in the above embodiment, a mode is possible in which they are constituted by the same material. For example, if they are constituted by a metallic material having excellent heat dissipation performance such as aluminum, the heat dissipation performance of the reactor is further improved. In particular, with this mode, if a configuration including a sealing resin is applied, heat from the coil and the magnetic core is efficiently transmitted to the case, and if an insulating resin is used as the sealing resin, insulation performance between the outer peripheral faces of the coil and the inner faces of the side wall portion is improved. With this mode as well, if a heat dissipation layer made of an insulating material is provided, the gap between the coil installation faces of the coil and the inner face of the installation face portion is narrow, thus achieving a compact configuration. A gap is provided so as to enable ensuring insulation performance between the outer peripheral faces of the coil and the inner faces of the side wall portion.

{Variation 2}

Although a mode in which the heat dissipation layer is constituted by an insulating adhesive is described in the above embodiment, a mode is possible in which the heat dissipation layer is constituted by a ceramic such as aluminum nitride or alumina.

{Variation 3}

A configuration in which the bobbin pieces 51 and the frame-shaped portions 52 of the insulator 5 are not integrated is described in the above embodiment. Alternatively, a configuration is possible in which bobbins 51α and frame-shaped portions 52α are engaged with each other so as to be integrated, as with an insulator 5α shown in FIG. 6. The following is a detailed description of the insulator 5α, and other configurations will not be described since they are the same as in the above embodiment.

The insulator 5α includes a pair of tubular bobbins 51α in which the inner core portions 31 of the magnetic core 3 are housed, and a pair of frame-shaped portions 52α that come into contact with the inner core portions 31 and the outer core portions 32. The bobbins 51α are tubular bodies that conform to the outer shape of the inner core portions 31, and the two end portions thereof are provided with fitting recession-projection portions 510 that are fitted with fitting recession-projection portions 520 of the frame-shaped portion 52α. The frame-shaped portions 52α are flat plate-shaped similarly to the frame-shaped portions 52 of the embodiment, and have a pair of opening portions in which the inner core portions 31 are inserted. The sides of the opening portions that come into contact with the bobbins 51α are provided with the fitting recession-projections 520 similarly to the bobbins 51α, and the sides that come into contact with the outer core portions 32 are provided with "]" shaped frame portions 521 for positioning the outer core portions 32. The fitting recession-projections 510 of the bobbins 51α and the fitting recession-projections 520 of the frame-shaped portion 52α are fitted with each other such that their positions can be held.

The assembly is configured using the insulator 5α as described below. First, a first one of the outer core portions 32 is placed with the inner end face thereof facing upward, and then a first one of the frame-shaped portions 52α is slid from the open side of the frame portion 521 such that that frame portion 521 is fitted onto the outer core portion 32. Through this step, the first outer core portion 32 is positioned with respect to the first frame-shaped portion 52α.

Next, the fitting recession-projections 510 of the bobbins 51α are fitted with the fitting recession-projections 520 of the first frame-shaped portion 52α, thus attaching the pair of bobbins 51α to that frame-shaped portion 52α. Through this step, the positional relationship between the first frame-shaped portion 52α and the bobbins 51α is held.

Next, the core pieces 31*m* and the gap members 31*g* are alternately inserted and laminated in the bobbins 51α. The laminated state of the inner core portions 31 obtained by laminating is held by the bobbins 51α. Here, a pair of side face portions of each bobbin 51α are shaped so as to include a slit that opens upward, and therefore the core pieces 31*m* can be supported by fingers or the like when the core pieces 31*m* and the gap members 31*g* are inserted into the bobbin 51α, thus making it possible to safely and easily perform this insertion operation.

Next, the two coil elements of the coil (not shown) are attached around the bobbins 51α with the coil joining portion side facing downward. Then the second frame-shaped portion 52α is attached to the bobbins 51α, and the second outer core portion 32 is attached to the second frame-shaped portion 52α as described above. Through this step, the positional relationship between the bobbins 51α and the second frame-shaped portion 52α is held, and the second outer core portion 32 is positioned with respect to the second frame-shaped portion 52α. Through this step, the assembly constituted by the coil and the magnetic core 3 is obtained.

Using the insulator 5α enables achieving a configuration in which an adhesive is not used when forming the magnetic core 3, similarly to the above embodiment. In particular, the bobbins 51α and the frame-shaped portions 52α of the insulator 5α can be easily maintained in an integrated state by being engaged with each other, and handling is easy when disposing the assembly on the installation face portion of the case, and the like.

Furthermore, in the case of a configuration in which the back face of the first outer core portion 32 is brought into contact with the side wall portion of the case, and a member (e.g., a plate spring) for pushing the other outer core portion 32 toward the first outer core portion 32 is inserted between the side wall portion and the back face of the second outer core portion 32, it is possible to prevent changes in the gaplength due to external factors such as vibration and impact. In a mode in which the pushing member is used, if the gap members 31*g* are elastic gap members constituted by an elastic material such as silicone rubber or fluorine-containing rubber, the deformation of the gap members 31*g* makes it possible to adjust the gap length and absorb dimensional error to a certain extent. The pushing member and the elastic gap members can be applied to the above-described embodiment and variations, as well as to the variations described below.

{Variation 4}

Alternatively, as another configuration in which an adhesive is not used when forming the magnetic core 3, it is possible to use a band-shaped constriction member (not shown) that can hold the magnetic core in an annular shape. As one example, the band-shaped constriction member includes a band portion that is disposed on the outer periphery of the magnetic core, and a lock portion that is attached to one end of the band portion and fixes the loop formed by the band portion to a predetermined length. As one example, the lock portion has an insertion hole for the insertion of the other end-side region of the band portion that has a protrusion, and a tooth portion provided in the insertion hole in order to engage with the protrusion of the band portion. Then, when a ratchet mechanism is configured by the protrusion in the other end-side region of the band portion and the tooth portion of the lock portion, it is possible to favorably use a constriction member whose loop can be fixed at the predetermined length.

The constituent material of the band-shaped constriction member is a material that is non-magnetic and has heat resistance sufficient to resist temperatures reached during use of the reactor, for example, examples of which include a metallic material such as stainless steel, and non-metallic materials such as heat-resistant polyamide resin, polyether ether ketone (PEEK) resin, polyethylene terephthalate (PET) resin, polytetrafluoroethylene (PTFE) resin, and polyphenylene sulfide (PPS) resin. Examples of commercially available binding materials that may be used include Tie Wrap (registered trademark of Thomas & Betts International, Inc.), PEEK Tie (binding band made by HellermannTyton Co., Ltd), and Stainless Steel Band (made by Panduit Corp.)).

When the assembly is assembled, the band portion of the band-shaped constriction member can be wrapped around, for example, the outer periphery of one of the outer core portions, between the outer periphery of one of the inner core portions and the inner peripheral faces of the coil elements, around the outer periphery of the other outer core portion, and between the outer periphery of the other one of the inner core portions and the inner peripheral faces of the coil elements, and the loop length is fixed with the lock portion, thus making it possible to fix the magnetic core in an annular shape. Alternatively, after the assembly constituted by the coil and the magnetic core is assembled as described above in the embodiment and the like, the loop length can be fixed by disposing the band portion so as to surround the outer periphery of the coil and the outer core portions. Using such a band-shaped constriction member enables integrating the magnetic core without using an adhesive, and the assembly can be easily handled when disposing the assembly on the installation face portion, for example. Also, the gap between the core pieces can be easily maintained.

Furthermore, in the case of a configuration in which a cushioning member is interposed between the band-shaped constriction member and the outer peripheries of the magnetic core and the coil, it is possible to suppress damage to the magnetic core and the coil due to the constriction force of the band-shaped constriction member. The material, thickness, number, disposed location, and the like of the cushioning member can be appropriately selected such that the constriction force acts on the magnetic core to the extent that the annular magnetic core can be held in a predetermined shape. For example, it is possible to use a cushioning member such as a rubber plate member made of silicone rubber or the like, or a molded part having a thickness of approximately 0.5 to 2 mm, which is obtained by a resin such as ABS resin, PPS resin, PBT resin, or epoxy resin being molded so as to conform to the core shape.

{Variation 5}

Figure 7:
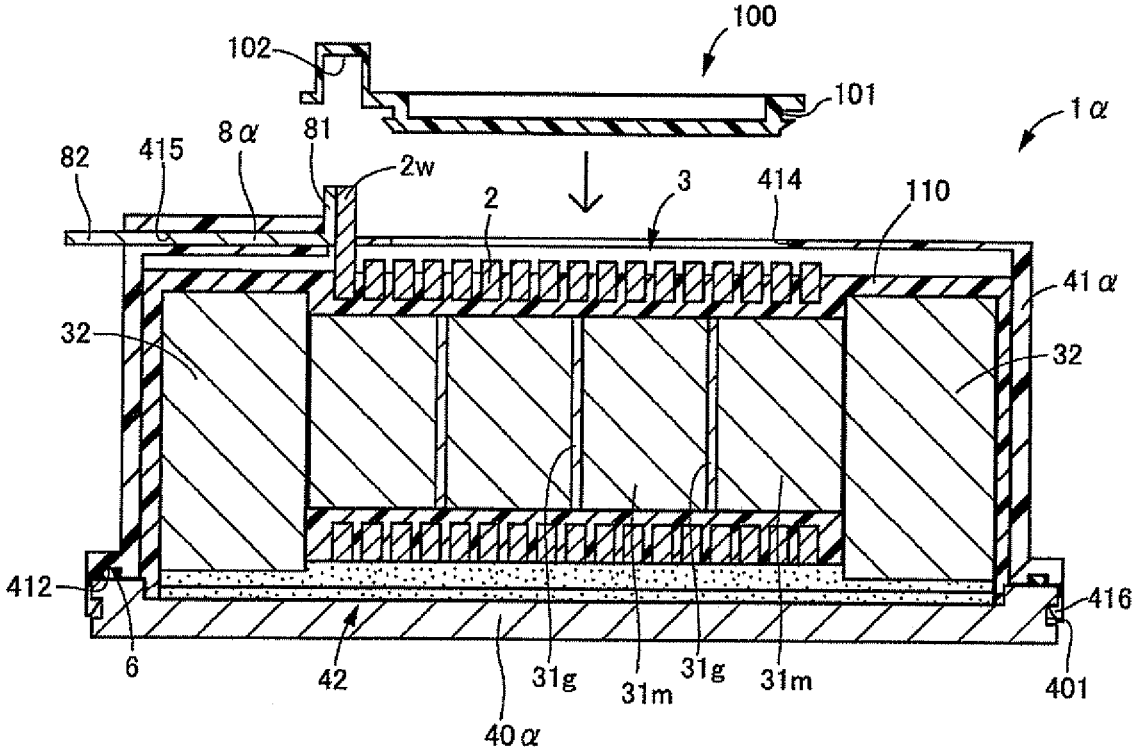
FIG. 7 is a cross-sectional diagram of another mode of the reactor, showing an overview corresponding to a cross-section VII-VII in FIG. 4.

A closure member 100 may be provided, as with a reactor 1α shown in FIG. 7. Structures of the reactor 1α that are similar to those of the reactor 1 have been given the same reference signs in the drawings, and descriptions thereof have been appropriately omitted. Note that FIG. 7 schematically shows a cross-section corresponding to the cross-section VII-VII in FIG. 4, and the insulator 5 and the like are not shown.

The closure member 100 is formed from synthetic resin, and in the case where a side wall portion 41α is made of resin, the closure member 100 may be formed from the same material as the side wall portion 41α, or may be formed from a different material than the side wall portion 41α. A fitting groove 101 that engages with an opening edge portion of an upper opening portion 414 of the side wall portion 41α on the side opposite to an installation face portion 40α, by the opening edge portion being fit into the fitting groove 101, is formed in the closure member 100. Also, a pair of terminal housing portions 102 (only one of which is shown in FIG. 7) that open toward the side wall portion 41α side (lower side in FIG. 7) are formed in the closure member 100.

Also, a terminal clamp 8α is pressed into a terminal indentation hole 415 formed in the side wall portion 41α from the connecting face 82 side, thus being fixed such that a connecting face 82 protrudes out from the side wall portion 41α. Also, when the side wall portion 41α and the assembly 10 are in the attached state, the end portion of the winding wire 2*w* and a welding face 81 protrude upward from the side wall portion 41α and are in contact with each other.

Note that the installation face portion 40α of the reactor 1α has a predetermined thickness dimension, and an engaging recessed portion 401 that opens outward is formed in the outer peripheral end face of the installation face portion 40α. Also, a locking catch 416 formed in the side wall portion 41α is locked by fitting into the engaging recessed portion 401, and thus the side wall portion 41α is attached to the installation face portion 40α.

Also, when the closure member 100 is attached to the side wall portion 41, the upper opening portion 414 is covered by the closure member 100, and the terminal housing portions 102 of the closure member 100 are placed over the welding face 81 of the terminal clamp 8α and the end portion of the winding wire 2*w* that protrude out from the side wall portion 41α. Note that in the case where the side wall portion 41α is filled with sealing resin 110, the sealing resin 110 is poured in so as to not completely fill the upper opening portion 414, and then the closure member 100 is attached to the side wall portion 41α.

According to this variation, the upper opening portion 414 of the side wall portion 41α can be easily and reliably covered by the closure member 100. Also, the portions where the terminal clamps 8α and the winding wire 2*w* are connected can be protected and insulated from the outside by the terminal housing portions 102 of the closure member 100.

Note that appropriate modifications can be made to the above-described embodiment without departing from the gist of the present invention, and there is no limitation to the above-described configurations.

Industrial Applicability

A reactor of the present invention can be favorably applied to a constituent part of a power conversion apparatus such as a vehicular converter mounted in a vehicle such as a hybrid automobile, an electrical automobile, or a fuel-cell automobile.

Reference Signs

1,1α Reactor
2 Coil
2*a*,2*b* Coil element
2*r* Coil joining portion
2*w* Winding wire
3 Magnetic core
31 Inner core portion
31*e* End face
31*m* Core piece
31*g* Gap member
32 Outer core portion
32*e* Inner end face
4 Case
40,40α Installation face portion
41,41α Side wall portion
42 Heat dissipation layer
400,411 Flange portion
400*h*,411*h* Bolt hole
410 Terminal block
410*c* Recessed groove
412 Housing groove
413 Positioning projection portion
5,5α Insulator
51,51α Bobbin piece
52,52α Frame-shaped portion
52*f* Flange portion
510,520 Fitting recession-projection
521 Frame portion
6 Packing
8,8α Terminal clamp
81 Welding face
82 Connecting face
9 Terminal fixing member
91 Bolt
10 Assembly
100 Closure member
110 Sealing resin

The invention claimed is:

1. A reactor comprising an assembly that has a coil and a magnetic core on which the coil is disposed, and a case that houses the assembly, the case comprising:

an installation face portion that can be fixed to a fixing target when the reactor is installed on the fixing target;

a side wall portion that is formed separately from the installation face portion, attached to the installation face portion, and surrounds the periphery of the assembly; and a heat dissipation layer that is formed on an inner face of the installation face portion and is interposed between the installation face portion and the coil, wherein the thermal conductivity of the installation face portion is greater than or equal to the thermal conductivity of the side wall portion, and the heat dissipation layer is constituted by an insulating material whose thermal conductivity exceeds 2 W/m·K.

2. The reactor according to claim 1, wherein the heat dissipation layer has a multi-layer structure constituted by an insulating adhesive, and the installation face portion is constituted by an electrically-conductive material.

3. The reactor according to claim 1, wherein the side wall portion is constituted by an insulating material.

4. The reactor according to claim 1, wherein the heat dissipation layer has a multi-layer structure constituted by an epoxy-based adhesive that contains an alumina filler, the installation face portion is constituted by aluminum or an aluminum alloy, and the side wall portion is constituted by an insulating resin.

5. The reactor according to claim 1, wherein the side wall portion is constituted by an insulating material, and the side wall portion is provided with a terminal block that fixes a terminal clamp for connection to the coil.

6. The reactor according to claim 1, wherein a contact piece portion is formed so as to be raised up on the terminal clamp for connection to the coil, and the contact piece portion is brought into contact with a portion of the coil that protrudes out from the side wall portion.

7. The reactor according to claim 6, comprising a closure member that is made of a resin and covers the contact piece portion of the terminal clamp and the portion of the coil that protrudes out from the side wall portion.

8. The reactor according to claim 1, wherein the side wall portion is constituted by an insulating material, and the side wall portion is provided with a positioning projection portion that comes into contact with the assembly and positions the assembly within the side wall portion.

9. The reactor according to claim 1, wherein a housing groove is formed in an outer peripheral portion of the side wall portion that overlaps with the installation face portion, and a gap between the side wall portion and the installation face portion is sealed by a sealing member housed in the housing groove.

* * * * *